US007213778B2

(12) United States Patent
Astafan et al.

(10) Patent No.: US 7,213,778 B2
(45) Date of Patent: May 8, 2007

(54) TIRE SIZE REDUCTION/WIRE SEPARATION SYSTEM

(75) Inventors: Charles G. Astafan, Osprey, FL (US); David A. Stuhlmiller, Bradenton, FL (US); Peter M. Moore, Bradenton, FL (US)

(73) Assignee: Columbus McKinnon Corporation, Amherst, NY (US)

( * ) Notice: Subject to any disclaimer, the term of this patent is extended or adjusted under 35 U.S.C. 154(b) by 246 days.

(21) Appl. No.: 11/006,270

(22) Filed: Dec. 7, 2004

(65) Prior Publication Data

US 2006/0118671 A1 Jun. 8, 2006

(51) Int. Cl.

| | |
|---|---|
| ***B02C 9/04*** | (2006.01) |
| ***B02C 13/00*** | (2006.01) |
| ***B02C 1/08*** | (2006.01) |
| ***B02C 1/10*** | (2006.01) |

(52) U.S. Cl. ..... 241/73; 241/197; 241/243; 241/294

(58) Field of Classification Search ..... 241/73, 241/166, 167, 242, 243, 294, 295, DIG. 31
See application file for complete search history.

(56) References Cited

U.S. PATENT DOCUMENTS

| | | | | |
|---|---|---|---|---|
| 2,060,126 | A * | 11/1936 | Scheynost | 241/238 |
| 4,113,191 | A * | 9/1978 | Wattles et al. | 241/188.2 |
| 5,150,844 | A * | 9/1992 | McKie | 241/73 |
| 5,273,218 | A * | 12/1993 | Burns | 241/32 |
| 5,474,239 | A * | 12/1995 | Williams et al. | 241/73 |

* cited by examiner

*Primary Examiner*—Faye Francis
(74) *Attorney, Agent, or Firm*—Edward P. Dutkiewicz

(57) ABSTRACT

A tire size reduction/wire separation system comprising a drive shaft; a plurality of rotors mounted on the drive shaft, each rotor having axial slots with a rotor mounted knife removably secured within each slot; and an independent housing supporting the drive shaft and rotors. The independent housing has a central region with stationary knives. The roots and crests of the stationary knives are matingly oriented and respect to the roots and crests of the rotor mounted knives The independent housing also has lateral regions including an annual wear ring vertically secured to the axial ends of the rotors. Each lateral region also includes a wear liner with a circular opening with a diameter greater than the exterior diameter of the wear rings.

5 Claims, 5 Drawing Sheets

FIG. 6
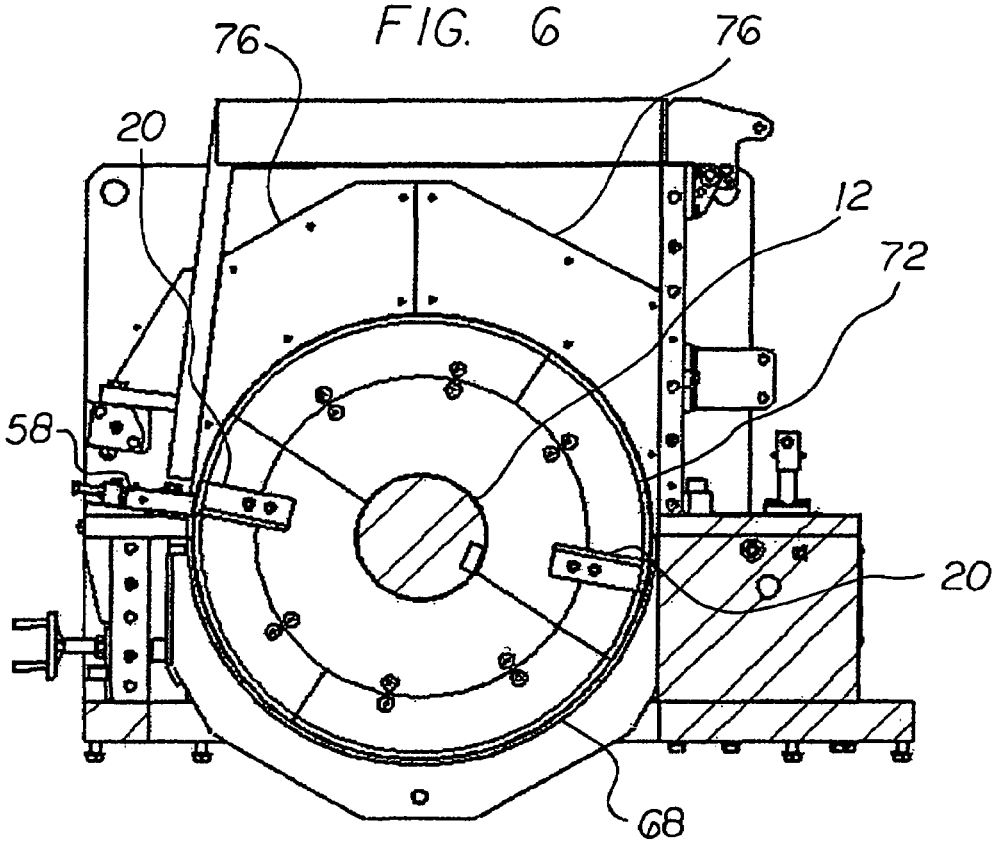
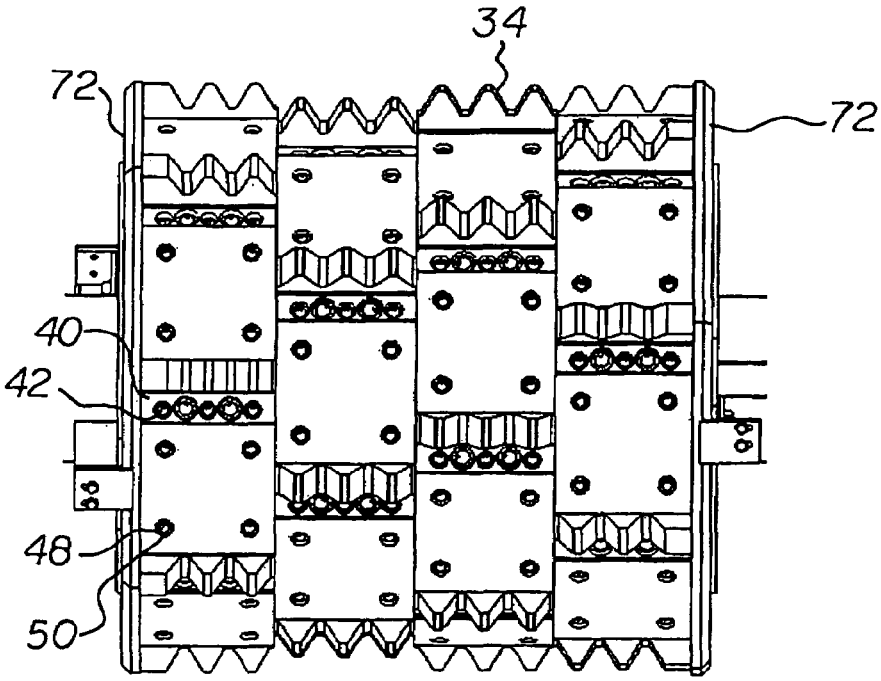
FIG 7

FIG. 8
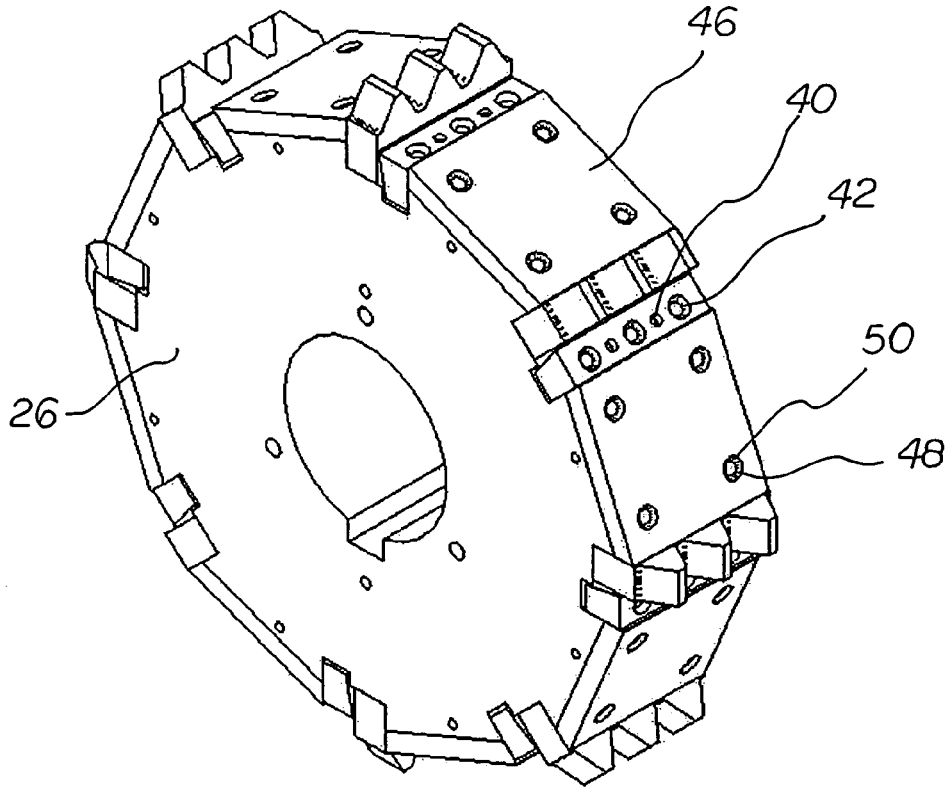
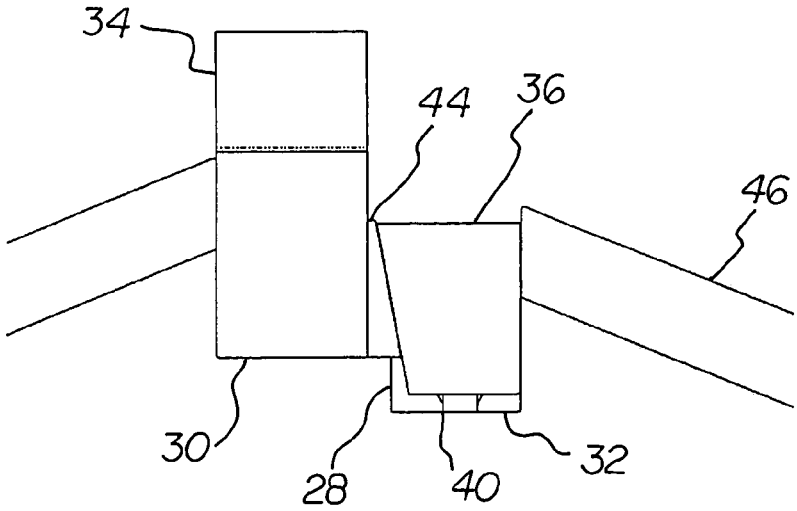
FIG. 9

TIRE SIZE REDUCTION/WIRE SEPARATION SYSTEM

BACKGROUND OF INVENTION

1. Field of the Invention

The present invention relates to a tire size reduction/wire separation system and more particularly pertains to the safe and efficient tire size reduction and/or wire separation of scrap tire material, cable and wire along with other materials that have properties that are commingled which need to be separated for means of recycling and recovery.

2. Description of the Prior Art

The use of tire reduction and separation devices of known designs and configurations is known in the prior art. More specifically, the reduction and separation devices of known designs and configurations previously devised and utilized are known to consist basically of familiar, expected, and obvious structural configurations, notwithstanding the myriad of designs encompassed by the crowded prior art, which has been developed for the fulfillment of countless objective and requirements.

By way of example, U.S. Pat. No. 3,214,106 issued Oct. 26 1965 to German discloses carbide tipped chipper. U.S. Pat. No. 3,779,123 issued Dec. 18, 1973 to Chafee discloses a knife holder and knife therefore. U.S. Pat. No. 1,423,867 issued Jul. 25, 1922 to Mitts and Winston discloses a cutting machine. U.S. Pat. No. 5,024,386 issued Jun. 18, 1991 to Morris discloses a tire converting method and apparatus.

While these devices fulfill their respective, particular objectives and requirements, the aforementioned patents do not describe a tire size reduction/wire separation system that allows safe and efficient tire size reduction and/or wire separation of scrap tire material, cable and wire along with other materials that have properties that are commingled which need to be separated for means of recycling and recovery.

In this respect, the tire size reduction/wire separation system according to the present invention substantially departs from the conventional concepts and designs for the prior art, and in doing so provides an apparatus primarily developed for the purpose of safe and efficient tire size reduction and/or wire separation of scrap tire material, cable and wire along with other materials that have properties that are commingled which need to be separated for means of recycling and recovery.

Therefore, it can be appreciated that there exists a continuing need for a new and improved tire size reduction/wire separation system which be used for the safe and efficient tire size reduction and/or wire separation of scrap tire material, cable and wire along with other materials that have properties that are commingled which need to be separated for means of recycling and recovery. In this regard the present invention substantially fulfills this need.

SUMMARY OF THE INVENTION

In the view of the foregoing disadvantages inherent in the known types of tire size reduction/wire systems of known designs and configuration now present in the prior art, the present invention provides an improved tire size reduction/wire separation system. As such, the general purpose of the present invention, which will be described subsequently in greater detail, is to provide a new and improved tire size reduction/wire separation system method, which has all the advantages of the prior art and none of the disadvantages.

To attain this, the present invention essentially comprises a tire size reduction/wire separation system for safe and efficient tire size reduction and/or wire separation of scrap tire material, cable and wire along with other materials that have properties that are commingled which need to be separated for means of recycling and recovery comprising, in combination, a drive shaft in a generally cylindrical configuration with a central section of an enlarged diameter and with end sections of a reduced diameter and with intermediate sections of an intermediate diameter located between the central section and end sections and with a pair of spaced bearings supporting the shaft at the intermediate sections for rotating the shaft about a horizontal axis of rotation and with end sections adapted to be coupled to a source of rotary power.

Next are a plurality of cylindrical rotors mounted on the central section of the drive shaft for rotation therewith the rotors having a common axis of rotation coextensive with the axis of rotation of the drive shaft, each rotor having a periphery with eight equally spaced axial slots, each axial slot having a shallow region and a deep region, a rotor mounted knife with teeth removably secured within each shallow region with a primary wedge removably received with each deep region and with a secondary wedge in each slot between each rotor mounted knife and primary wedge, each primary wedge and a deep groove having threaded apertures with bolts for securement purposes, a wear plate between each primary wedge and the rotor mounted knife of the next adjacent slot, each wear plate and rotor there adjacent having threaded apertures with bolts for securement purposes, the knives of each rotor being offset from the knives of each other rotor to form a helix tending to move the material toward the axial center of the rotors during rotation of the rotors.

Next is a base plate supporting the independent housing, bearings, drive shaft and rotors within the independent housing and with the end sections of the drive shaft extending laterally from the independent housing.

The independent housing has a central region with stationary knives, each knife having horizontally aligned fixed teeth with vertically extending roots and crests adjacent to the horizontal mid-plane of the rotors, the roots and crests of the stationary knives being matingly oriented with respect to the roots and crests of the rotor mounted knives the roots and crests of the rotor mounted and stationary knives being spaced to allow the cutting, tearing and separation of the commingled material.

The independent housing also has an upper region above the mid-plane of the rotors with a chamber for receiving the material to be shredded by the rotor mounted and stationary knives.

The independent housing also has a lower region beneath the mid-plane of the rotors, the lower region including a semi-cylindrical screen concentric with the rotors for the passage there through of material passing between the rotor mounted and stationary knives.

Lastly, the independent housing also has lateral regions adjacent to the axial ends of the rotors, each lateral region including an annual wear ring with an exterior diameter greater than the diameter of the rotors and vertically secured to the axial ends of the rotors for rotating therewith, each lateral region also including a wear liner vertically secured with respect to the chamber and positioned adjacent to the axial ends of the rotors and fixed with respect thereto, each wear liner having a circular opening with a diameter greater than the exterior diameter of the wear rings and concentrically receiving the wear rings there within and forming a gap there between for the passage of small particles, each lateral region also including a supplemental plate vertically secured with respect to the chamber and positioned laterally exterior of the wear liners and fixed with respect thereto, the supplemental plate and wear ring at each end of the rotors defining a passageway for the movement of small material from the upper region to the lower region. The gap and passageway are kept clear by the use of replaceable wipers attached to the wear rings.

There has thus been outlined rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out several purposes of the present invention. It is important, therefore, that the claims be regarded as including such equivalent constructions insofar as they do not depart from the spirit and scope of the present invention.

It is, therefore, an object of the present invention to provide a new and improved tire size reduction/wire separation system which has all of the advantages of the prior art tire reduction and separation system which may be easily and efficiently manufactured and marketed.

It is further object of the present invention to provide a new and improved tire reduction and separation system which is of durable and reliable construction.

An even further object of the present invention is to provide a new and improved tire reduction and separation system which is susceptible of a low cost of manufacture with regard to both materials and labor, and which accordingly is then susceptible of low prices of sale to the consuming public, thereby making such tire reduction and separation system economically available to the buying public.

Even still another object of the present invention is to provide a tire reduction and separation system for safe and efficient tire size reduction and/or wire separation of scrap tire material, cable and wire along with other materials that have properties that are commingled which need to be separated for means of recycling and recovery.

Lastly, it is an object of the present invention to provide a new and improved tire reduction and separation system comprising a drive shaft, a plurality of rotors mounted on the drive shaft, each rotor having axial slots with a rotor mounted knife removably secured within each slot; and a base plate supporting an independent housing, bearings, drive shaft and rotors, the independent housing having stationary knives, the roots and crests of the stationary knives being matingly oriented with respect to the roots and crests of the rotor mounted knives, the independent housing also having lateral regions adjacent to the axial ends of the rotors, each lateral region including an annual wear ring with an exterior diameter greater than the diameter of the rotors and vertically secured to the axial ends of the rotors for rotating therewith, each lateral regions also including a wear liner vertically secured adjacent to the axial ends of the rotors and fixed with respect thereto, each wear liner having a circular opening with a diameter greater than the exterior diameter of the wear rings and concentrically receiving the wear rings there within, forming a gap which is kept clear by the use of replaceable wipers attached to the wear rings.

These together with other objects of the invention, along with the various features of novelty which characterize the invention, are pointed out with particularity in the claims annexed to and forming apart of this disclosure. For a better understanding of the invention, its operating advantages and the specific objects attained by its uses, reference should be made to the accompanying drawings and descriptive matter in which there is illustrated preferred embodiment of the invention as described herein.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a cross sectional view taken transverse to the axis of rotation of FIGS. 1 through 2.

FIG. 7 is a front elevational view of a stack-up of rotors shown in FIG. 2.

FIG. 8 is a perspective illustration of one of the rotors shown in FIGS. 1, 2 and 7.

FIG. 9 is an enlarged side elevational view of a knife, primary wedge and secondary wedge of FIGS. 7 and 8.

The same reference numerals refer to the same parts throughout the various Figures.

DESCRIPTION OF THE PREFERRED EMBODIMENT

Figure 1:
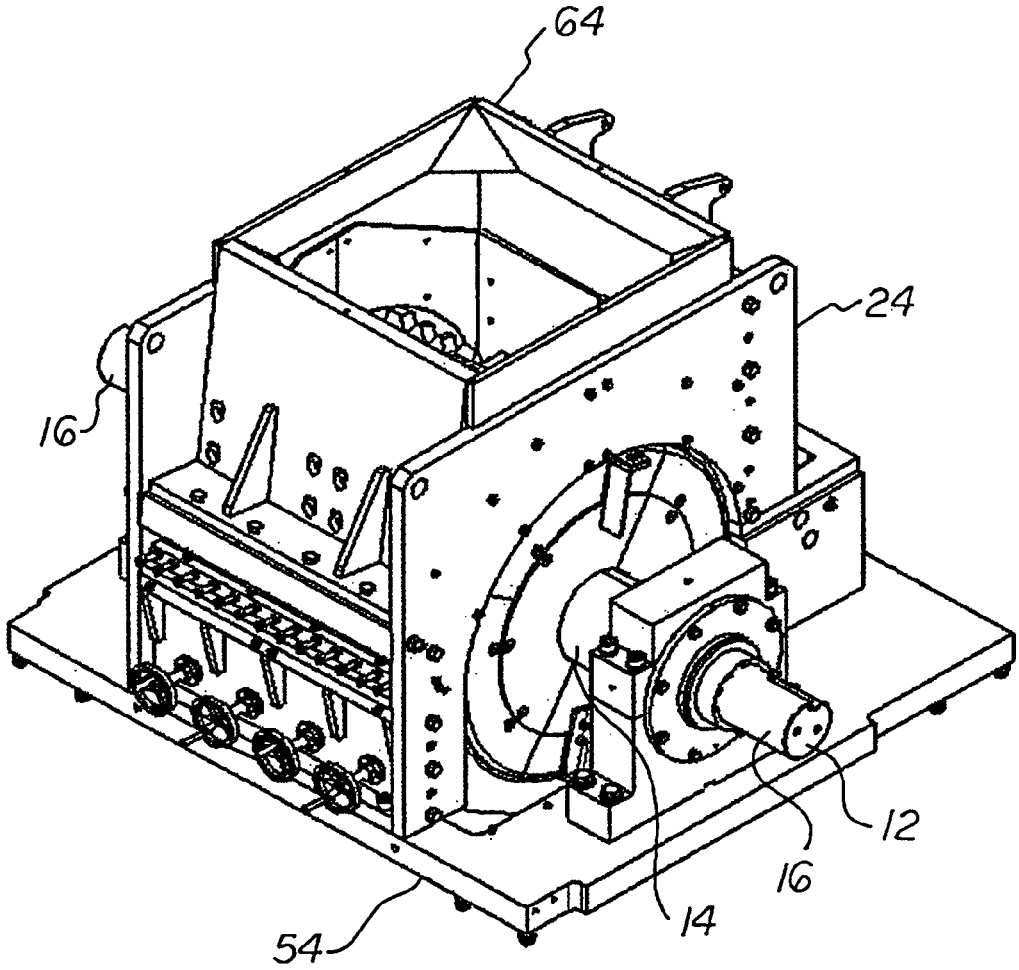
FIG. 1 is a perspective illustration of a tire shredder system constructed in accordance with the principles of the present invention.
Figure 2:
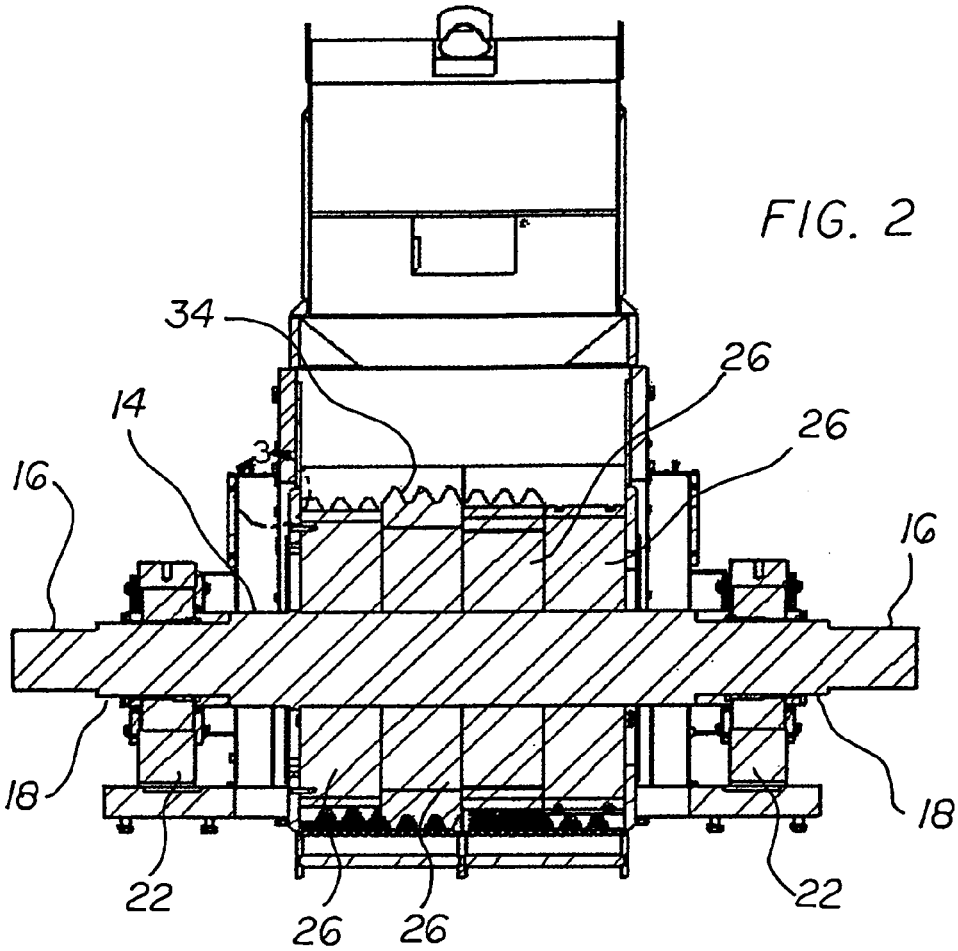
FIG. 2 is a cross sectional view taken vertically through the axis of rotation of the system of FIG. 1, the FIG. 2 showing including a number of rotors for the purpose of clarity.
Figure 3:
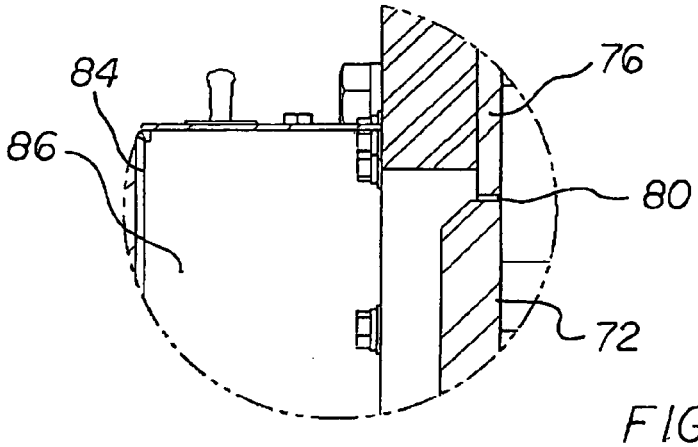
FIG. 3 is an enlarged showing of the gap and adjacent components taken at Circle 3 of FIG. 2.
Figure 4:
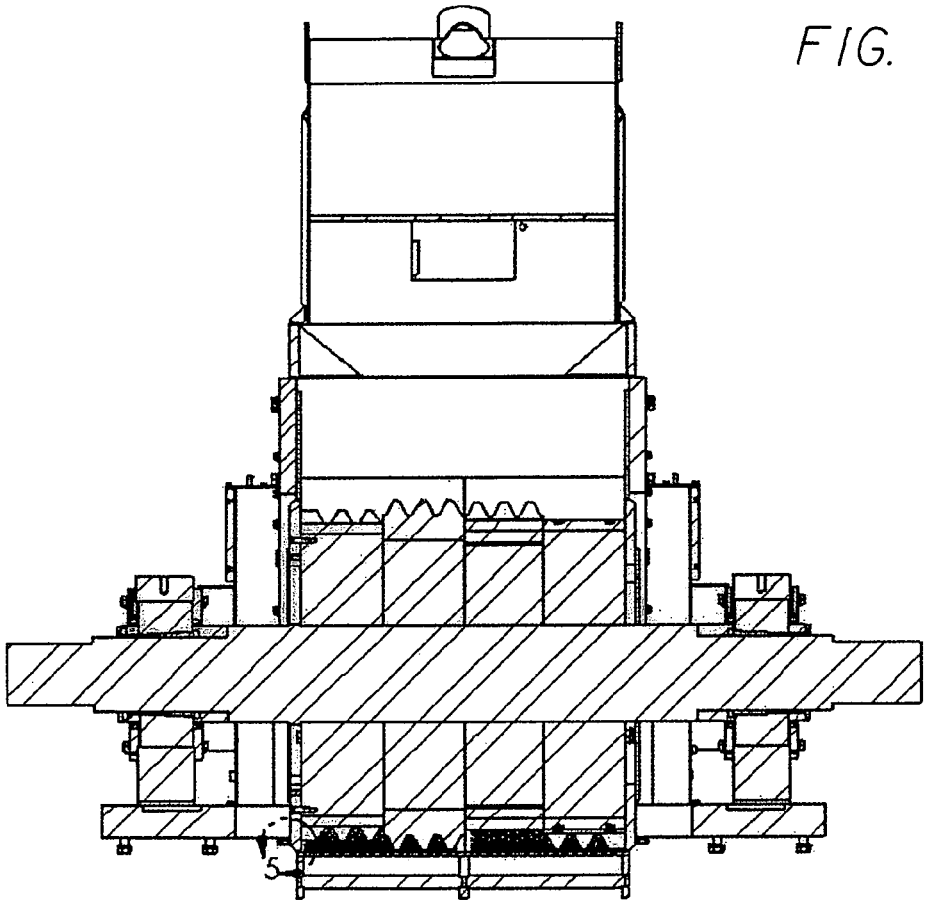
FIG. 4 is again a cross sectional view taken vertically through the axis of rotation of the system of FIG. 1, the FIG. 4 giving notice to Circle 5.
Figure 5:
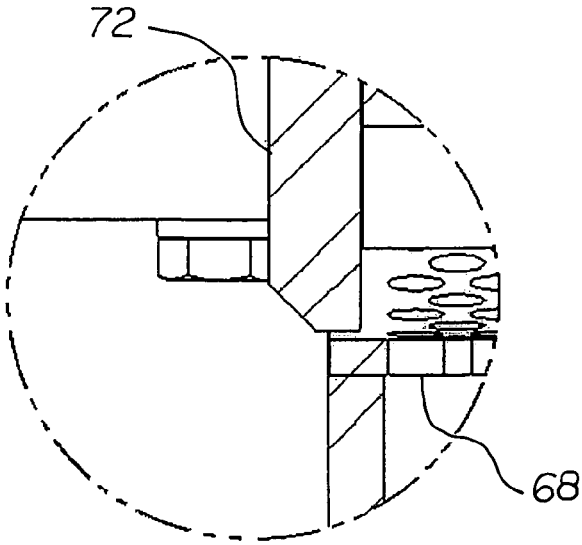
FIG. 5 is an enlarged cross sectional view taken Circle 5 of FIG. 4.

With reference now to the drawings, and in particular to FIG. 1 thereof, the preferred embodiment of the new and improved tire size reduction/wire separation system embodying the principles and concepts of the present invention will be described.

The present invention, the tire size reduction/wire separation system, is comprised of a plurality of components. Such components in their broadest context include a drive shaft, rotors with knives and an independent housing with central, upper and lower sections. Such components are individually configured and correlated with respect to each other so as to attain the desired objectives. The components form a tire size reduction/wire separation system for the safe and efficient size reduction and wire separation of scrap tire material, cable and wire along with other materials that have properties that are commingled which need to be separated for means of recycling and recovery.

The first component of the system is a drive shaft 12 in a generally cylindrical configuration. The drive shaft has a central section 14 of an enlarged diameter. The drive shaft also has end sections 16 of a reduced diameter. The drive shaft also has intermediate sections 18 of an intermediate diameter located between the central section and end sections. A pair of spaced bearings 22 support the shaft at the intermediate sections for rotating the shaft about a horizontal axis of rotation. The end sections are adapted to be coupled to a source of rotary power.

A plurality of generally cylindrical rotors 26 are mounted on the central section of the drive shaft for rotation therewith. The rotors have a common axis of rotation coextensive with the axis of rotation of the drive shaft. Each rotor has a periphery with eight equally spaced axial slots 28. Each axial slot has a shallow region 30 and a deep region 32. A rotor mounted knife 34 with teeth is removably secured within each shallow region along with a primary wedge 36 and a secondary wedge 44. Each primary wedge and deep groove have threaded apertures 40 with bolts 42 for securement purposes. A wear plate 46 is provided between each primary wedge and the rotor mounted knife of the next adjacent slot. Each wear plate and rotor there adjacent has threaded apertures 48 with bolts 50 for securement purposes. The knives of each rotor are offset from the knives of each other rotor to form a helix tending to move the material toward the axial center of the rotors during rotation of the rotors.

Next provided is a base plate 54. The base plate supports an independent housing 24, bearings 22, drive shaft 12 and rotors 26. The end sections of the drive shaft extend laterally from the independent housing.

The independent housing also has a central region with stationary knives 58. Each knife has horizontally aligned fixed teeth with vertically extending roots and crests adjacent to the horizontal mid-plane of the rotors. The roots and crests of the stationary knives are matingly oriented with respect to the roots and crests of the rotor mounted knives. The roots and crests of the rotor mounted and stationary knives are spaced to allow the cutting, tearing and separation of the commingled material.

The independent housing also has an upper region above the mid-plane of the rotors with a chamber 64 for receiving the material to be shredded by the rotor mounted and stationary knives.

The independent housing also has a lower region beneath the mid-plane of the rotors. The lower region includes a semi-cylindrical screen 68 concentric with the rotors for the passage there through of material passing between the rotor mounted and stationary knives.

Lastly, the independent housing also has lateral regions adjacent to the axial ends of the rotors. Each lateral region includes an annual wear ring 72 with an exterior diameter greater than the diameter of the rotors and vertically secured to the axial ends of the rotors for rotating therewith. Each lateral region also includes a wear liner 76 vertically secured with respect to the chamber and positioned adjacent to the axial ends of the rotors and fixed with respect thereto. Each wear liner has a circular opening with a diameter greater than the exterior diameter of the wear rings 72 and concentrically receiving the wear rings there within and forming a gap 80 there between for the passage of small particles. Each lateral region also includes a supplemental plate 84 vertically secured with respect to the chamber and positioned laterally exterior of the wear liners and fixed with respect thereto. The supplemental plate and wear ring at each end of the rotors define a passageway 86 for the movement of small material from the upper region to the lower region. The gap 80 and passageway 86 are kept clear by the use of replaceable wipers 20.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tire size reduction/wire separation system for the safe and efficient size reduction and wire separation of scrap tire material, cable and wire which need to be separated for means of recycling and recovery, the system comprising, in combination:

a drive shaft in a generally cylindrical configuration with a central section of an enlarged diameter and with end sections of a reduced diameter and with intermediate sections of an intermediate diameter located between the central section and end sections and with a pair of spaced bearings supporting the shaft at the intermediate sections for rotating the shaft about a horizontal axis of rotation;

a plurality of generally cylindrical rotors mounted on the central section of the drive shaft for rotation therewith, the rotors having a common axis of rotation coextensive with the axis of rotation of the drive shaft, each rotor having a periphery with eight equally spaced axial slots, each axial slot having a shallow region and a deep region, a rotor mounted knife with teeth removably secured within each shallow region, each said slot having a primary wedge and secondary wedge, each primary wedge and deep region having threaded apertures with bolts for securement purposes, a replaceable wear plate between each primary wedge and the rotor mounted knife of the next adjacent slot, each wear plate and rotor there adjacent having threaded apertures with bolts for securement purposes, the knives of each rotor being offset from the knives of each other rotor to form a helix tending to move the material toward the axial center of the rotors during rotation of the rotors;

an independent housing having a base plate supporting the bearings with the rotors within the independent housing and with the end sections of the drive shaft extending laterally from the independent housing;

said independent housing also having a central region with stationary knives, each stationary knife having horizontally aligned fixed teeth, the stationary knives being matingly oriented with respect to the rotor mounted knives;

said independent housing also having an upper region above the mid-plane of the rotors with a chamber for receiving material to be shredded by the rotor mounted knives and the stationary knives;

said independent housing also having a lower region beneath the mid-plane of the rotors, the lower region including a semi-cylindrical screen concentric with the rotors for the passage there through of material passing between the rotatable and stationary knives; and said independent housing also having lateral regions adjacent to the axial ends of the rotors, each lateral region including an annular wear ring with an exterior diameter greater than the diameter of the rotors and vertically secured to the axial ends of the rotors for rotating therewith, each lateral region also including a wear liner vertically secured with respect to the chamber and positioned adjacent to the axial ends of the rotors and fixed with respect thereto, each wear liner having a circular opening with a diameter greater than the exterior diameter of the wear rings and concentrically receiving said annular wear rings there within and forming a gap there between for the passage of small particles, each lateral region also including a supplemental plate vertically secured with respect to the chamber and positioned laterally exterior of the wear liners and fixed with respect thereto, the supplemental plate and wear ring at each end of the rotors defining a passageway for the movement of small material from the upper region to the lower region, the gap and the passageway adapted to be kept clear by the use of replaceable wipers.

2. A tire size reduction/wire separation system comprising:

a drive shaft;

a plurality of rotors mounted on the drive shaft, each rotor having axial slots and a rotor mounted knife removably secured within each slot; and a base plate and an independent housing on the base plate, the drive shaft and rotors also supported on the base plate, the independent housing having stationary knives, the stationary knives being matingly oriented with respect to the rotor mounted knives the independent housing also having lateral regions adjacent to the axial ends of the rotors, each lateral region including an annual wear ring and wipers with an exterior diameter greater than the diameter of the rotors and vertically secured to the axial ends of the rotors for rotating therewith, each lateral region also including a wear liner vertically secured adjacent to the axial ends of the rotors and fixed with respect thereto, each wear liner having a circular opening with a diameter greater than the exterior diameter of the wear rings and concentrically receiving the wear rings there within.

3. The system as set forth in claim 2 wherein each slot has a shallow region and a deep region, each said rotor mounted knife being removably secured within each shallow region and a primary wedge removably received with each deep region and with a secondary wedge in each slot between each rotor mounted knife and primary wedge.

4. The system as set forth in claim 2 wherein each wear ring and its associated wear liner are spaced to form a gap there between for the passage of small particles of material.

5. The system as set forth in claim 2 wherein the rotor wear plates are replaceable and protect the rotors from wear erosion.

* * * * *